US006966870B2

(12) United States Patent
Lan

(10) Patent No.: US 6,966,870 B2
(45) Date of Patent: Nov. 22, 2005

(54) SWIMMING EXERCISER

(76) Inventor: Jen-Fan Lan, No. 178, Chiahsin, Hsincheng Hsiang, Hualien Hsien (TW)

( * ) Notice: Subject to any disclaimer, the term of this patent is extended or adjusted under 35 U.S.C. 154(b) by 68 days.

(21) Appl. No.: 10/812,453

(22) Filed: Mar. 29, 2004

(65) Prior Publication Data

US 2005/0215398 A1 Sep. 29, 2005

(51) Int. Cl.[7] ..... A63B 23/00
(52) U.S. Cl. ..... 482/55; 434/254
(58) Field of Search ..... 482/51, 55, 69, 482/121; 119/771, 784; 434/254; 4/513, 4/498; 441/116, 136; 211/50, 55; 280/801, 280/808

(56) References Cited

U.S. PATENT DOCUMENTS 3,988,020 A * 10/1976 Carter ..... 482/55
4,248,419 A * 2/1981 Hohwart ..... 482/55
4,551,108 A * 11/1985 Bass ..... 482/69
4,577,859 A * 3/1986 Gossett ..... 482/55
5,192,256 A * 3/1993 Ryan ..... 482/55
6,176,815 B1 * 1/2001 Riera ..... 482/55
6,905,444 B2 * 6/2005 Milton ..... 482/55

* cited by examiner

*Primary Examiner*—Stephen R. Crow
(74) *Attorney, Agent, or Firm*—Dellett & Walters

(57) ABSTRACT

A swimming exerciser includes a pair of height adjusting devices each having a base for secure engagement with a pool side and a pole mounted on the base and provided with a slot and multiple cutouts defined in the pole to communicate with the slot. A pair of resilient devices each has a positioning block, a head extending from a side of the positioning block to be movably received in a corresponding one of the cutouts and an elastic strap oppositely formed relative to the head and having a hook. A trapping device has a loop and two opposed rings on the loop to correspond to the two hooks of the two resilient devices. After a swimmer's waist is received in the loop, the swimmer is able to swim in a supported manner in the pool.

2 Claims, 6 Drawing Sheets

SWIMMING EXERCISER

BACKGROUND OF THE INVENTION

1. Field of the Invention

The present invention relates to a swimming exerciser, and more particularly to a swimming exerciser to allow the swimmer to practice swimming in a limited area.

2. Description of Related Art

Swimming is a very healthy exercising sport, which is able to build up the lung capability and exercise every muscle. Especially, those who suffer from chronic bone diseases e.g. arthritis are often advised by doctors to go swimming to strengthen the bones and muscle strength.

However, it is well-known that to bathe in public swimming pools is to expose oneself to potential risks of contracting contagious diseases. Furthermore, some people are rather shy about wearing only a swimming costume in public, especially when many athletically-developed people may also be at the public pool. Although having one's own swimming pool would help reduce the risk of disease, few people are wealthy enough to have their own pool which is sufficiently large to swim back and forth. Yet a further problem is that it is natural for a person to fear his or her head going below the surface of the water, as well as taking in pool water through the mouth which may also be unhealthy. To overcome the shortcomings, the present invention tends to provide a swimming exerciser to mitigate the aforementioned problems.

SUMMARY OF THE INVENTION

The primary objective of the present invention is to provide a swimming exerciser to enable the swimmer to swim in a limited area. Another objective of the present invention is to provide a swimming exerciser adapted to combine with a pool small enough to be economic whereby people can avoid going to public pools and thus avoid contagious diseases.

Another objective of the present invention is to provide a floatation board on a side of the swimming exerciser to avoid the swimmer taking in water from the pool.

Other objects, advantages and novel features of the invention will become more apparent from the following detailed description when taken in conjunction with the accompanying drawings.

DETAILED DESCRIPTION OF THE PREFERRED EMBODIMENT

Figure 1:
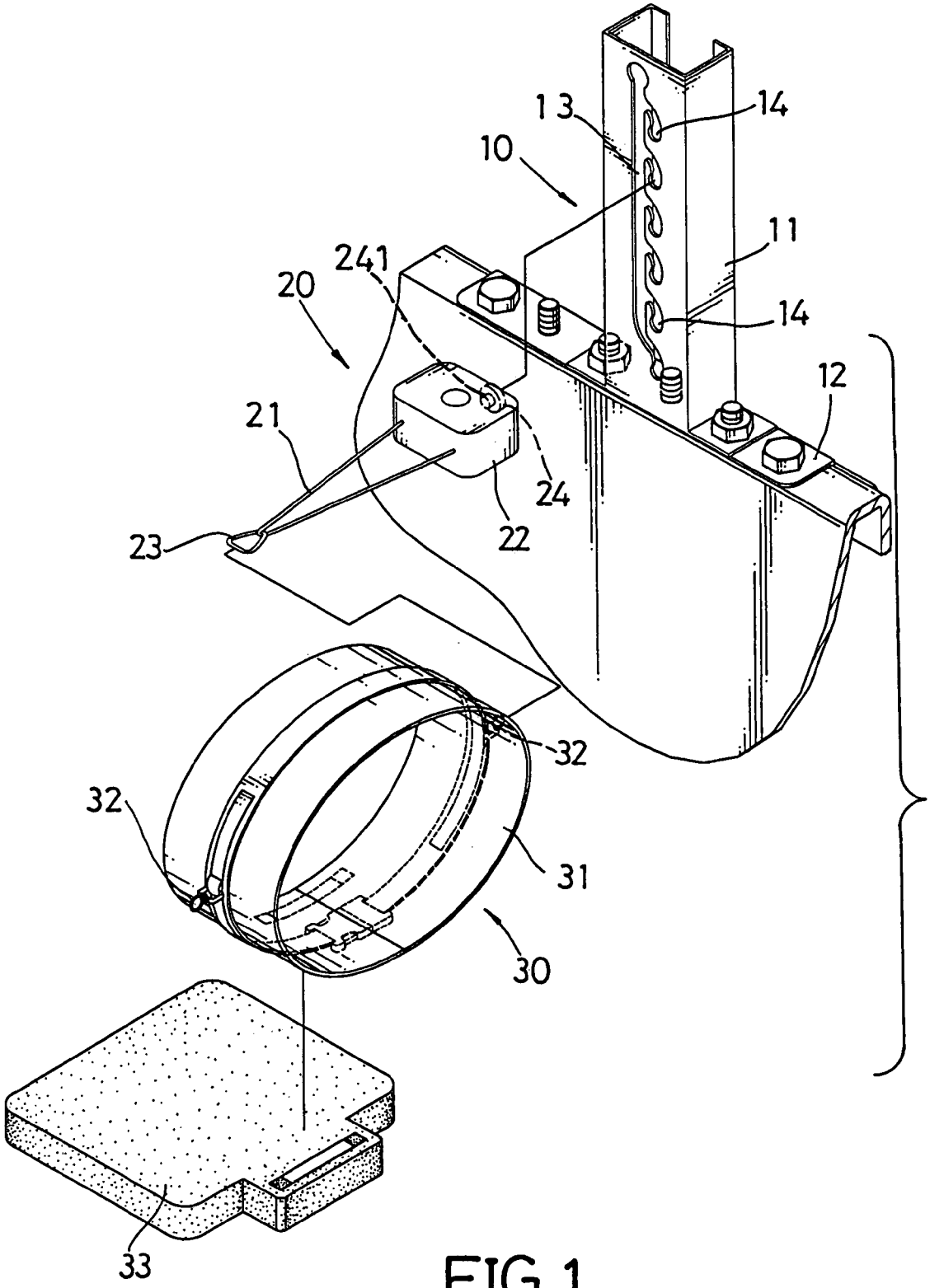
FIG. 1 is a schematic perspective view showing the structure of the present invention.
Figure 3:
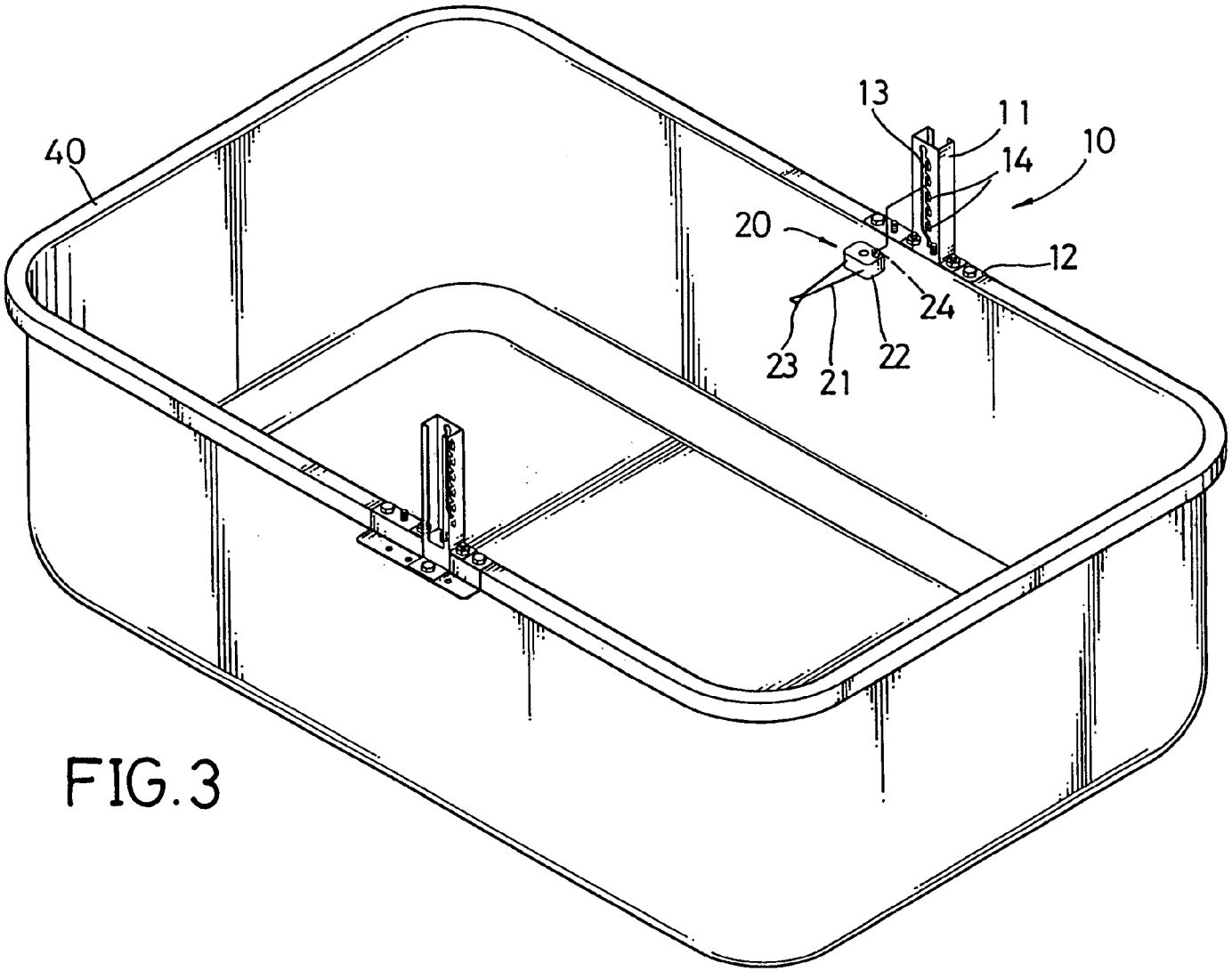
FIG. 3 is a schematic perspective view showing the application of the height adjusting device, a resilient device and a pool.

With reference to FIG. 1, it is noted that the swimming exerciser has a height adjusting device (10), a resilient device (20), a trapping device (30) and a pool (40) (as shown in FIG. 3).

Figure 2:
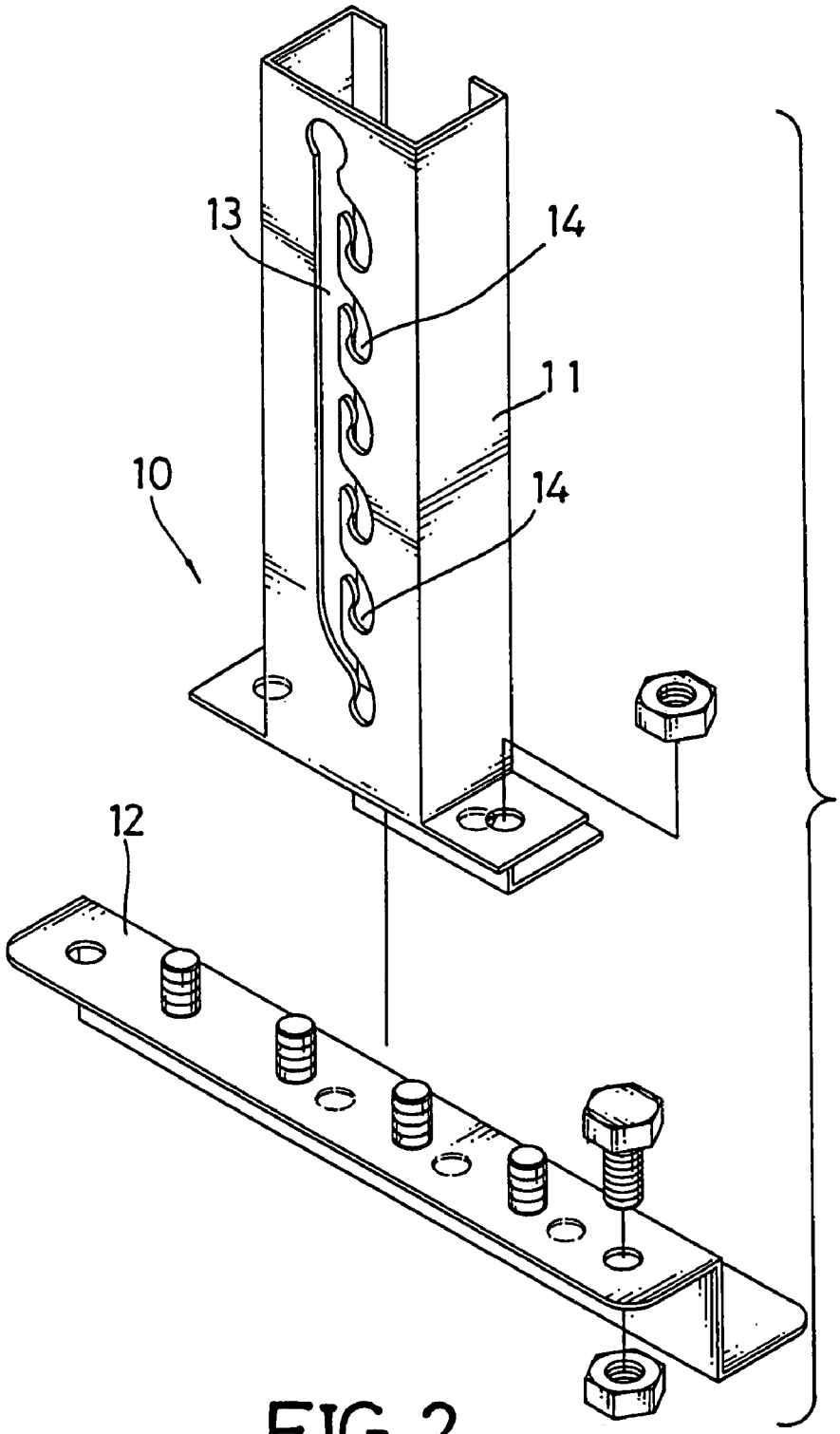
FIG. 2 is an exploded perspective view of the height adjusting device of the present invention.

With reference to FIG. 2 and still using FIG. 1 as reference, the height adjusting device (10) includes a pole (11) and a base (12) configured for secure engagement to a pool side. The pole (11) has a slot (13) axially defined in the pole (11) and multiple cutouts (14) defined in the pole (11) and communicating with the slot (13). The pole (11) is securely formed on the base (12) by any appropriate known methods in the art.

The resilient device (20) includes an elastic strap (21) extending out from a side of a positioning block (22), a hook (23) formed on a free end of the elastic strap (21) and a head (24) formed on a side of the positioning block (22) and opposite relative to the elastic strap (21). The head (24) has a neck (241) extending from the side of the positioning block (20) and slidably received in the slot (13).

The trapping device (30) is provided with a loop (31) for trapping therein a portion of the swimmer's body, e.g. waist, and two opposed rings (32) to correspond to the hook (23) of the resilient strap (21). A flotation board (33) may be adhered to a side of the loop (31).

Figure 4:
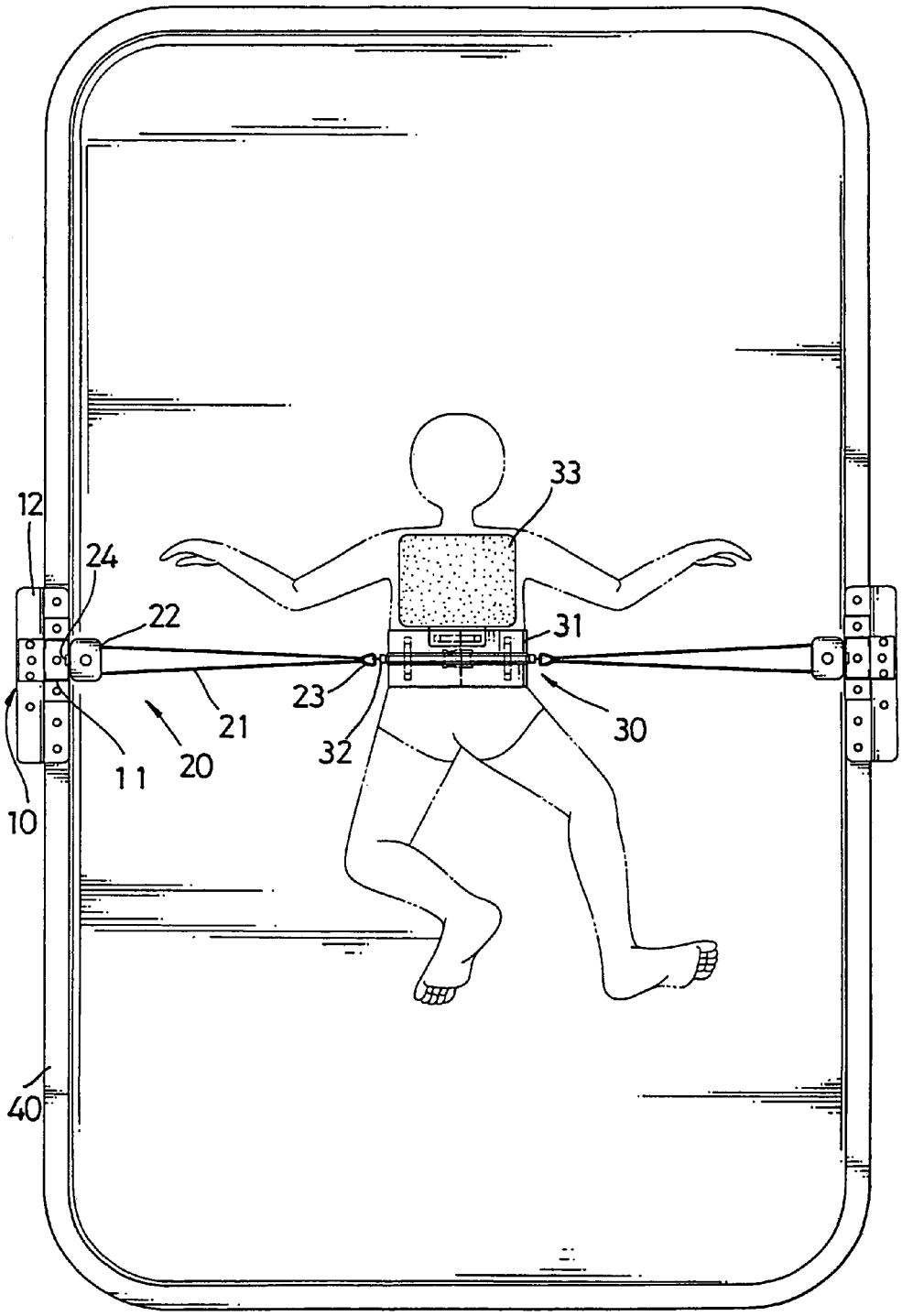
FIG. 4 is a schematic view showing the application of the swimming exerciser.

With reference to FIGS. 3 and 4, it is noted that when the swimming exerciser of the present invention is in application, two bases (12) are securely and oppositely mounted on a side of the pool (40) with the pole (11) respectively mounted on the two bases (12). Then the head (24) is securely received in a corresponding cutout (14) in the respective pole (11). The hook (23) from respective resilient device (20) is securely engaged with the ring (32) of the trapping device (30).

Figure 5:
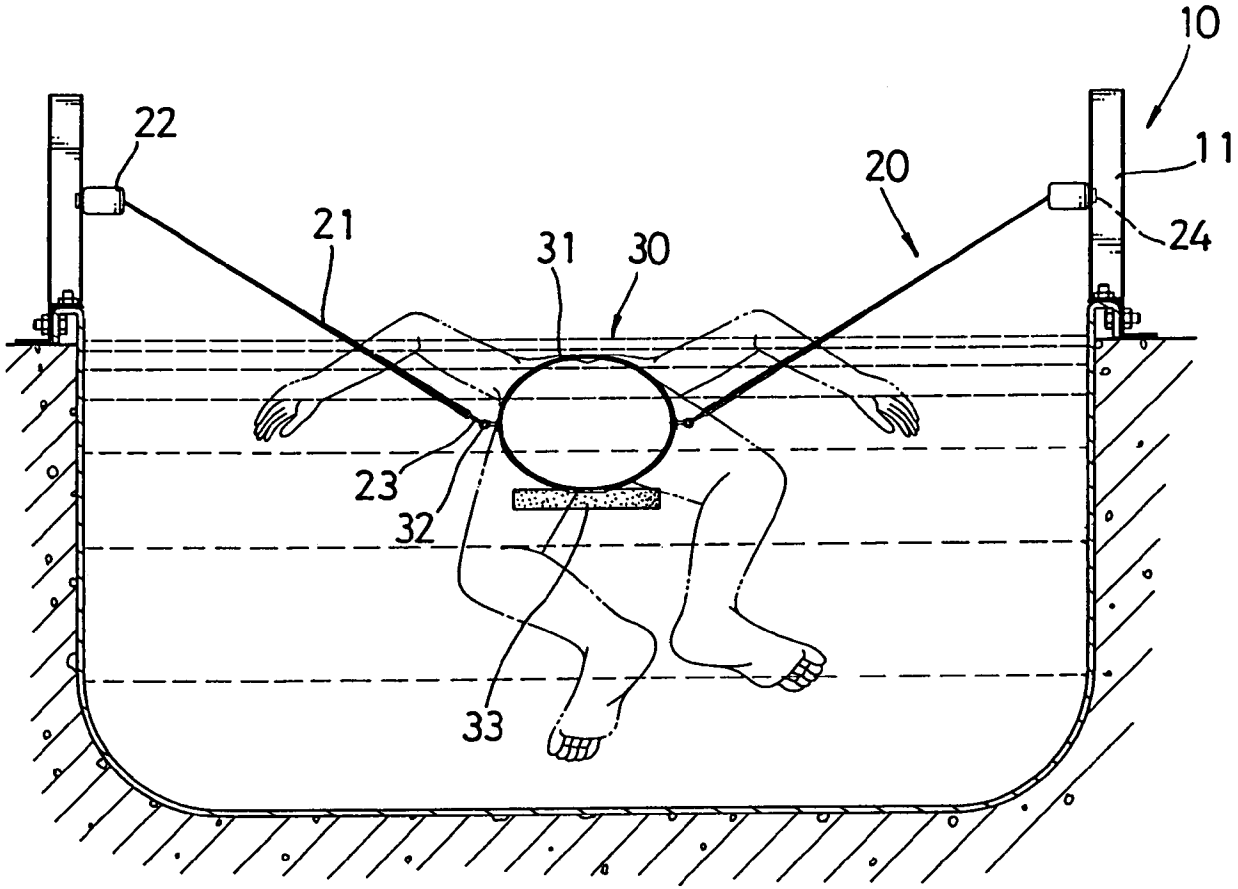
FIG. 5 is a schematic front view showing the adjustment of the height adjusting device.
Figure 6:
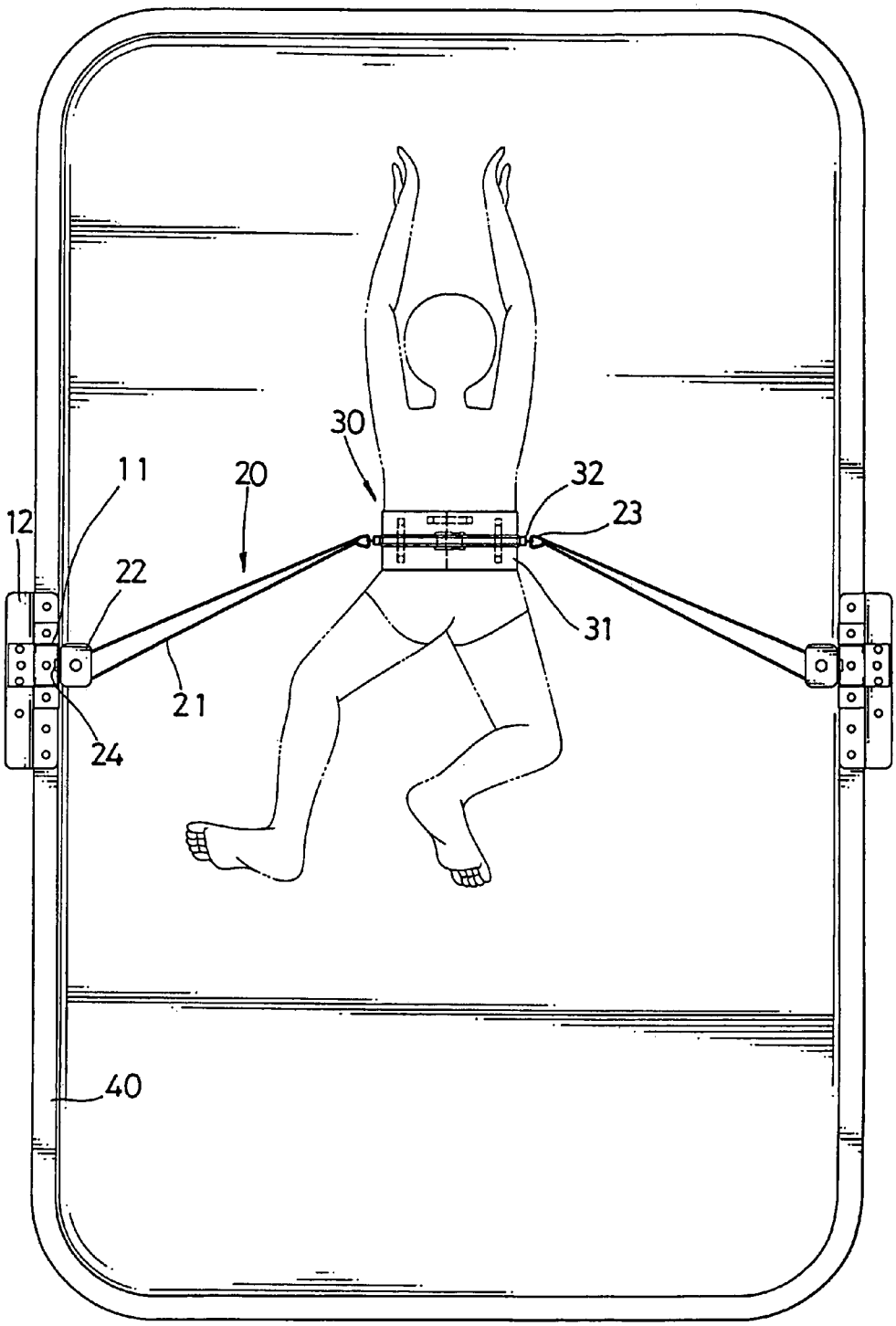
FIG. 6 is a schematic top view showing that the swimmer is swimming forward in the pool.

With reference to FIGS. 5 and 6 and taking FIG. 4 for reference, after the loop (31) is used to trap for example the waist of the swimmer, the swimmer is able to use the height adjusting devices (10) on opposite sides of the swimming pool (40) to adjust the resiliency of the elastic strap (21) of the resilient device (20) such that the swimmer is able to encounter different resistances when swimming in the pool (40).

Furthermore, the application of the flotation board (33) on a side of the loop (31) helps the swimmer to float on the water surface so that the taking in of water is avoided and thus even a beginner swimmer is encouraged to swim.

By using the swimming exerciser of the present invention, the swimmer is able to use a tank at home to perform swimming exercise without having the potential risk of contracting contagious diseases by going to a public swimming pool.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A swimming exerciser adapted to be fitted to a swimming pool, comprising:

a pair of height adjusting devices each having a base for secure engagement with respective sides of the swimming pool, and a pole mounted on the base and provided with a slot and multiple cutouts defined in the pole to communicate with the slot;

a pair of resilient devices each having a positioning block, a head extending from a side of the positioning block to be movably received in a corresponding one of the cutouts and an elastic strap oppositely formed relative to the head and having a hook; and a trapping device having a loop and two opposed rings on the loop to correspond to the two hooks of the two resilient devices, whereby after a swimmer's waist is received in the loop, the swimmer is able to swim in a supported manner in the swimming pool.

2. The swimming exerciser as claimed in claim 1, wherein a flotation board is attached to a side of the loop to help the swimmer to float on the surface of water in the swimming pool.

* * * * *